US010626000B2

(12) United States Patent
Kimura

(10) Patent No.: US 10,626,000 B2
(45) Date of Patent: Apr. 21, 2020

(54) INDUSTRIAL VEHICLE

(71) Applicant: Mitsubishi Logisnext Co., Ltd., Kyoto (JP)

(72) Inventor: Harukazu Kimura, Kyoto (JP)

(73) Assignee: Mitsubishi Logisnext Co., Ltd., Kyoto (JP)

( * ) Notice: Subject to any disclaimer, the term of this patent is extended or adjusted under 35 U.S.C. 154(b) by 0 days.

(21) Appl. No.: 16/308,504

(22) PCT Filed: Jun. 16, 2016

(86) PCT No.: PCT/JP2016/067998

§ 371 (c)(1),
(2) Date: Dec. 10, 2018

(87) PCT Pub. No.: WO2017/216935

PCT Pub. Date: Dec. 21, 2017

(65) Prior Publication Data

US 2019/0270629 A1 Sep. 5, 2019

(51) Int. Cl.
*B66F 9/22* (2006.01)
*B66F 9/07* (2006.01)
(Continued)

(52) U.S. Cl.
CPC ..... *B66F 9/22* (2013.01); *B66F 9/07* (2013.01); *B66F 9/205* (2013.01); *B66F 9/24* (2013.01)

(58) Field of Classification Search
CPC .... B66F 9/22; B66F 9/24; B66F 9/205; B66F 9/07
See application file for complete search history.

(56) References Cited

U.S. PATENT DOCUMENTS 8,126,618 B2 * 2/2012 Yamada ..... B60K 28/04 180/273
8,731,785 B2 * 5/2014 McCabe ..... B60G 17/016 701/50

(Continued)

FOREIGN PATENT DOCUMENTS

JP H04-353130 12/1992
JP 2009-542555 12/2009

OTHER PUBLICATIONS

International Search Report in corresponding international application No. PCT/JP2016/067998, dated Jun. 16, 2015.

(Continued)

*Primary Examiner* — Thomas E Lazo
(74) *Attorney, Agent, or Firm* — Kirschstein, Israel, Schiffmiller & Pieroni, P.C.

(57) ABSTRACT

An industrial vehicle includes a holding portion for holding a load, a raising/lowering portion for raising/lowering the holding portion, a control valve for controlling the amount of hydraulic oil supplied to or discharged from the raising/lowering portion, and a control device for supplying an energizing current to the control valve. The control device includes a speed calculation unit for calculating first and second speed command values for an ascending/descending speed, a current calculation unit for calculating first and second current command values for the energizing current, and a current supply portion for supplying first and second energizing currents to the control valve, thereby offsetting a first vibration generated in the load upon start of supplying the first energizing current, by a second vibration generated in the load upon start of supplying the second energizing current.

6 Claims, 7 Drawing Sheets

(51) Int. Cl.
*B66F 9/20* (2006.01)
*B66F 9/24* (2006.01)

(56) References Cited

U.S. PATENT DOCUMENTS

| | | | | |
|---|---|---|---|---|
| 9,403,667 | B2 * | 8/2016 | McCabe | B60G 17/08 |
| 2005/0177292 | A1 | 8/2005 | Okamura et al. | |
| 2009/0312875 | A1 * | 12/2009 | Lehtonen | B66F 9/07559 700/280 |

OTHER PUBLICATIONS

Supplementary European Search Report in corresponding European application No. 16905490, dated Feb. 20, 2020.

* cited by examiner

INDUSTRIAL VEHICLE

TECHNICAL FIELD

The present invention relates to industrial vehicles such as a forklift.

BACKGROUND ART

FIG. 5 illustrates a conventional forklift 100. The forklift 100 includes forks 3 for holding a load 2, masts 4 to which the forks 3 are attached so as to be able to ascend and descend, hydraulic cylinders 5 for performing an operation of raising/lowering the forks 3 and the masts 4, a lift lever 6 for starting/stopping the raising/lowering operation, a hydraulic device 7 for supplying hydraulic oil to the hydraulic cylinders 5 and discharging the hydraulic oil from the hydraulic cylinders 5, a control valve 8 for controlling amounts of hydraulic oil supplied and discharged, and a control device 20 for controlling the hydraulic device 7 and the control valve 8.

The control device 20 includes a current calculation portion 20A and a current supply portion 20B, as shown in FIG. 6. The current calculation portion 20A calculates a current command value on the basis of a start/stop signal outputted by the lift lever 6 and outputs a current command regarding the current command value to the current supply portion 20B. The current supply portion 20B supplies the control valve 8 with an energizing current in accordance with the current command value. Moreover, the current supply portion 20B outputs a drive signal to a motor 7C for use in driving a pump 7B, and supplies the hydraulic cylinders 5 with hydraulic oil in a tank 7A.

Incidentally, the forklift 100 has a problem where the load 2 on the forks 3 is vertically vibrated when the forks 3 starts a raising/lowering operation (particularly, a lowering operation). As a solution for this problem, there is a method in which a different vibration is generated in the load 2 after the raising/lowering operation is started, thereby offsetting the vibration caused at the start of the raising/lowering operation (see, for example, Patent Document 1).

Described below is an example where the solution is applied when an operation of lowering the forks 3 is started. The lift lever 6 is shifted by an operator over a period from time $t_{10}$ to time $t_{11}$, as shown in FIG. 7(A), and when a tilt angle of the lift lever 6 reaches X (e.g., a maximum tilt angle) at time $t_{11}$, the operation of lowering the forks 3 is started.

Once the forks 3 start descending at time $t_{11}$, a first vibration is generated at the center of gravity G of the load 2, as shown in FIG. 7(B). In this case, by generating a second vibration at the center of gravity G of the load 2 at time $t_{12}$, the first vibration can be reduced by offsetting. Preferably, the second vibration is 180° out of phase with the first vibration and has the same amplitude as the first vibration (strictly, the second vibration has a smaller amplitude by an amount of attenuation, as shown in FIG. 7(B)).

In the case of the forklift 100, to generate the second vibration at time $t_{12}$, the current calculation portion 20A increases the current command value in two steps, as shown in FIG. 7(C). Specifically, the current command value is gradually increased from 0 to B11 (one half of B12) over a period from time $t_{11}$ to time $t_{11}'$ and is maintained at B11 from time $t_{11}'$ until time $t_{12}$ before being gradually increased from B11 to B12 over a period from time $t_{12}$ to time $t_{12}'$. As a result, the energizing current supplied to the control valve 8 is gradually increased in two steps in accordance with the current command value, so that the forks 3 gradually descend in two steps.

PRIOR ART DOCUMENT

Patent Document

Patent Document 1: Japanese National Phase PCT Laid-Open Publication No. 2009-542555

DISCLOSURE OF THE INVENTION

Problems to be Solved by the Invention

In the case of the forklift 100, since the forks 3 gradually descend in two steps, as described above, the operator might perceive a delay in the forks 3 starting to move. That is, the forklift 100 has a problem where the operator experiences poor operability.

Furthermore, in the case of the forklift 100, to match the first vibration and the second vibration in terms of amplitude, the current command value B11 is set at one half of the current command value B12. Here, the amplitude of the first and second vibrations is linearly related to a descending speed of the forks 3, which is also linearly related to the amount of hydraulic oil supplied/discharged by the control valve 8. However, the energizing current and the amount of hydraulic oil supplied/discharged are not linearly related to each other, and therefore, even if the energizing current is halved by halving the current command value, the amount of hydraulic oil supplied/discharged (i.e., the descending speed of the forks 3) might not be halved.

That is, in the case of the forklift 100, the first vibration and the second vibration might not be matched in terms of amplitude, and if so, the first vibration cannot be efficiently offset by the second vibration, with the result that the vibration of the load 2 cannot be reduced sufficiently.

The present invention has been achieved under the above circumstances, with a problem thereof being to provide an industrial vehicle capable of reducing a delay in movement of forks when a raising/lowering operation is started and also capable of sufficiently reducing a load vibration when the raising/lowering operation is started.

Solution to the Problems

To solve the above problem, an industrial vehicle according to the present invention includes a holding portion for holding a load, a raising/lowering portion for performing an operation of raising/lowering the holding portion at an ascending/descending speed in accordance with an amount of hydraulic oil supplied/discharged, an operating portion for outputting a start signal for starting the raising/lowering operation, a control valve for controlling the amount of hydraulic oil supplied/discharged, in accordance with an energizing current, and a control device for supplying the energizing current to the control valve, wherein the control device includes a speed calculation portion for, when the start signal is inputted, calculating a first speed command value for the ascending/descending speed and a second speed command value having a higher absolute value than the first speed command value, and outputting speed commands regarding the first speed command value and the second speed command value, a current calculation portion for calculating a first current command value for the energizing current based on the first speed command value and a second current command value for the energizing current based on the second speed command value, and outputting current commands regarding the first current command value and the second current command value, and a current supply portion for supplying the control valve with a first energizing current in accordance with the first current command value and thereafter a second energizing current in accordance with the second current command value, thereby offsetting a first vibration by a second vibration, the first vibration being generated in the load upon start of supplying the first energizing current, the second vibration being generated in the load upon start of supplying the second energizing current.

In the industrial vehicle, the operating portion outputs a stop signal for stopping the raising/lowering operation, the speed calculation portion, when the stop signal is inputted, calculates a third speed command value having a lower absolute value than the second speed command value, a first intermediate speed command value between the second speed command value and the third speed command value, and a second intermediate speed command value between the third speed command value and zero, and outputting speed commands regarding the first intermediate speed command value, the third speed command value, and the second intermediate speed command value, the current calculation portion calculates a first intermediate current command value for the energizing current based on the first intermediate speed command value, a third current command value for the energizing current based on the third speed command value, and a second intermediate current command value for the energizing current based on the second intermediate speed command value, and outputs current commands regarding the first intermediate current command value, the third current command value, and the second intermediate current command value, the current supply portion supplies the control valve with a first intermediate energizing current in accordance with the first intermediate current command value, then a third energizing current in accordance with the third current command value, and then a second intermediate energizing current in accordance with the second intermediate current command value, thereby offsetting a third vibration by a fourth vibration, the third vibration being generated in the load upon switching from the second energizing current to the first intermediate energizing current, the fourth vibration being generated in the load upon switching from the third energizing current to the second intermediate energizing current.

Preferably, the industrial vehicle includes a load detection portion for detecting a weight of the load, and a memory portion having stored therein first vibration data indicating a relationship between the weight and the first vibration, wherein the speed calculation portion calculates the first speed command value and the second speed command value based on the weight and the first vibration data, and determines a time to output the speed command regarding the second speed command value.

Preferably, in the industrial vehicle, the memory portion has stored therein second vibration data indicating a relationship between the weight and the third vibration, and the speed calculation portion calculates the first intermediate speed command value, the third speed command value, and the second intermediate speed command value based on the second speed command value, the weight, and the second vibration data, and determines a time to output the speed command regarding the second intermediate speed command value.

In the industrial vehicle, the speed calculation portion can be configured to output the speed command regarding the second speed command value such that the energizing current switches from the first energizing current to the second energizing current when displacement of the first vibration makes a first return to zero.

In the industrial vehicle, the speed calculation portion can be configured to output the speed command regarding the second intermediate speed command value such that the energizing current switches from the third energizing current to the second intermediate energizing current when displacement of the third vibration makes a first return to zero.

Effect of the Invention

The present invention renders it possible to provide an industrial vehicle capable of reducing a delay in movement of forks when a raising/lowering operation is started and also capable of sufficiently reducing a load vibration when the raising/lowering operation is started.

MODE FOR CARRYING OUT THE INVENTION

Hereinafter, an embodiment of an industrial vehicle according to the present invention will be described with reference to the accompanying drawings. Note that as an example of the industrial vehicle, a reach forklift will be described below. Moreover, unless otherwise specified, front/rear, right/left, and up/down directions will be given with respect to a body of the reach forklift.

Figure 1:
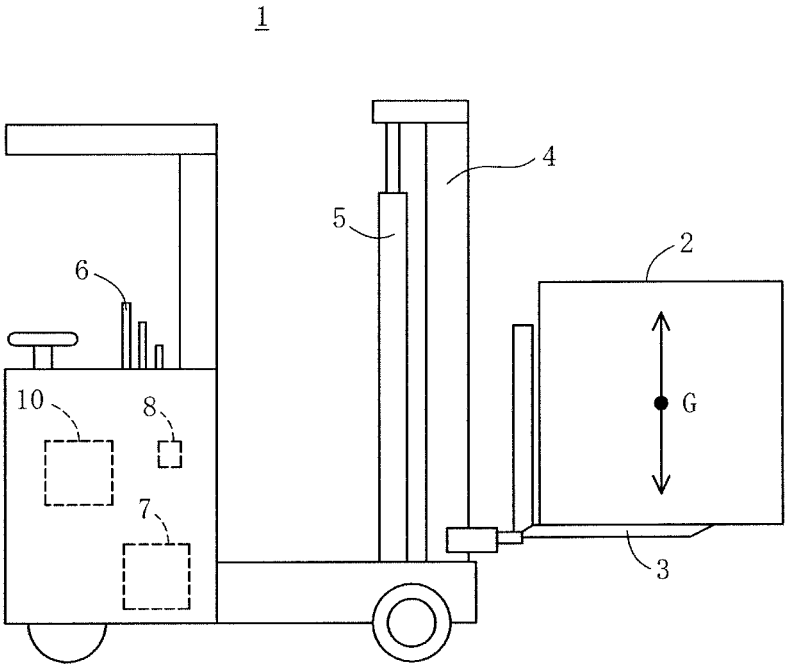
FIG. 1 is a side view of an industrial vehicle according to the present invention.

FIG. 1 illustrates the reach forklift (referred to below as the forklift) 1 according to the embodiment of the present invention. The forklift 1 includes forks 3 for holding a load 2, a pair of right and left masts 4 to which the forks 3 are attached so as to be able to ascend and descend, a pair of right and left hydraulic cylinders 5 for performing an operation of raising/lowering the forks 3 along the masts 4 at an ascending/descending speed in accordance with the amount of hydraulic oil supplied/discharged, and a lift lever 6 for starting/stopping the raising/lowering operation. The forks 3 and the masts 4 correspond to the "holding portion" of the present invention. The hydraulic cylinders 5 correspond to the "raising/lowering portion" of the present invention. The lift lever 6 corresponds to the "operating portion" of the present invention.

The operator tilts the lift lever 6 from neutral to raise position (e.g., backward), thereby starting an extending operation of the hydraulic cylinders 5 and hence the operation of raising the forks 3 along the masts 4. The operator tilts the lift lever 6 from neutral to lower position (e.g., forward), thereby starting a retracting operation of the hydraulic cylinders 5 and hence the operation of lowering the forks 3 along the masts 4. Moreover, the operator returns the lift lever 6 to the neutral position, thereby stopping the extending/retracting operation of the hydraulic cylinders 5 and hence the operation of raising/lowering the forks 3 along the masts 4.

The lift lever 6 includes an angle detection means (e.g., a potentiometer). The angle detection means detects a tilt angle of the lift lever 6 on the premise that the tilt angle is 0° when the lift lever 6 is in the neutral position, and outputs a signal regarding the detected tilt angle. The signal corresponds to the "start signal" of the present invention where the tilt angle changes from 0° and also to the "stop signal" of the present invention where the tilt angle changes toward 0°.

Figure 2:
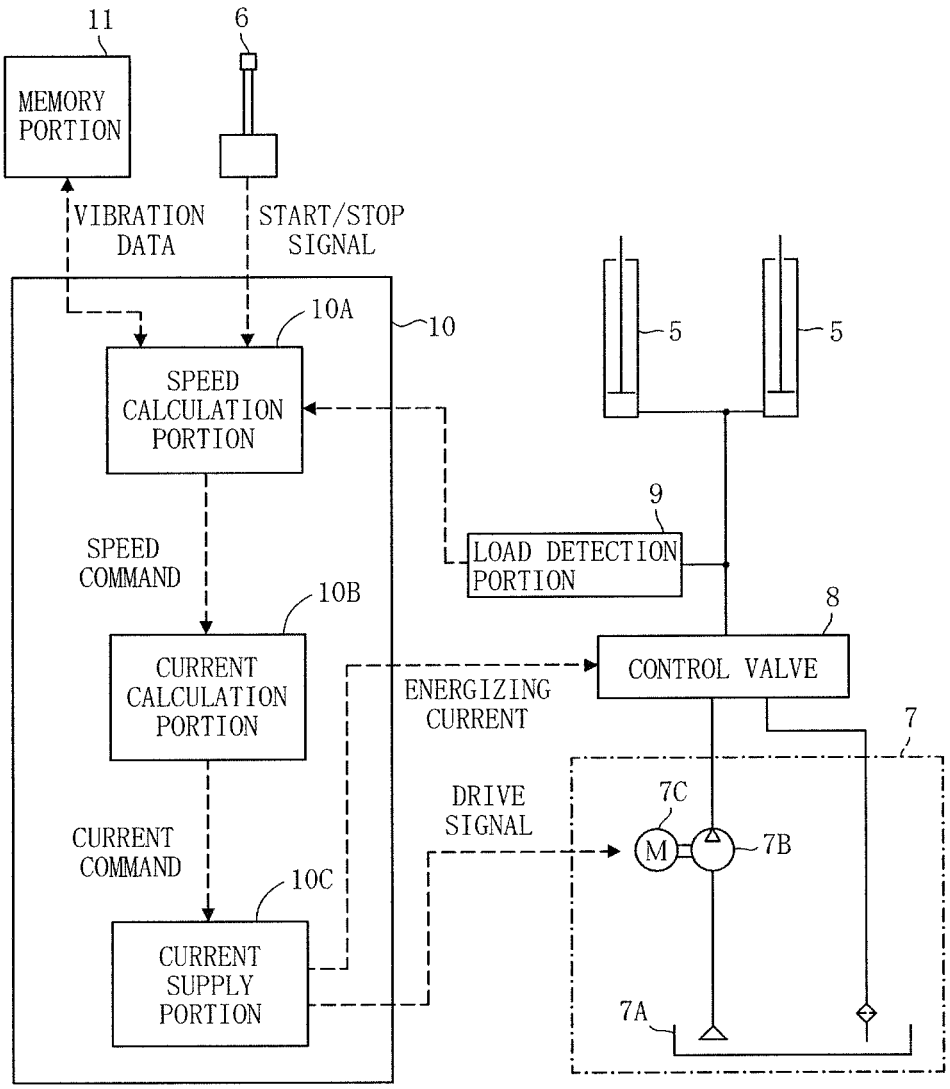
FIG. 2 is a diagram illustrating a control device and peripheral features thereof in the present invention.

The forklift 1 further includes a hydraulic device 7, a control valve 8, a load detection portion 9, a control device 10, and a memory portion 11, all of which are provided within the body, as shown in FIGS. 1 and 2.

The hydraulic device 7 includes a tank 7A in which hydraulic oil is contained, a pump 7B for supplying the control valve 8 with the hydraulic oil in the tank 7A, a motor 7C for driving the pump 7B, a hydraulic oil supply path, and a hydraulic oil discharge path. The pump 7B is provided in the hydraulic oil supply path.

The control valve 8 controls the amounts of hydraulic oil supplied and discharged (the amount to be supplied and the amount to be discharged) in accordance with an energizing current. Specifically, the control valve 8 includes a first valve provided in the hydraulic oil supply path, a first electromagnetic coil (first solenoid) for changing the degree to which the first valve is open, in accordance with the energizing current, a second valve provided in the hydraulic oil discharge path, and a second electromagnetic coil (second solenoid) for changing the degree to which the second valve is open, in accordance with the energizing current. When the lift lever 6 is in the neutral position, the degree to which the first and second valves are open is zero, so that the amounts of hydraulic oil supplied and discharged are zero. When the lift lever 6 is tilted to the raise position, the degree to which the second valve is open remains zero, and the first valve is open to a degree in accordance with the energizing current, so that the amount of hydraulic oil supplied is in accordance with the energizing current. When the lift lever 6 is tilted to the lower position, the degree to which the first valve is open remains zero, and the second valve is open to a degree in accordance with the energizing current, so that the amount of hydraulic oil discharged is in accordance with the energizing current.

The load detection portion 9 is an oil pressure sensor for detecting oil pressure between the hydraulic cylinders 5 and the control valve 8. The oil pressure between the hydraulic cylinders 5 and the control valve 8 increases in proportion to the weight of the load 2. Accordingly, by detecting the oil pressure, the weight of the load 2 can be detected indirectly. The load detection portion 9 outputs a voltage signal linearly related to the detected weight to a speed calculation portion 10A of the control device 10.

Figure 6:
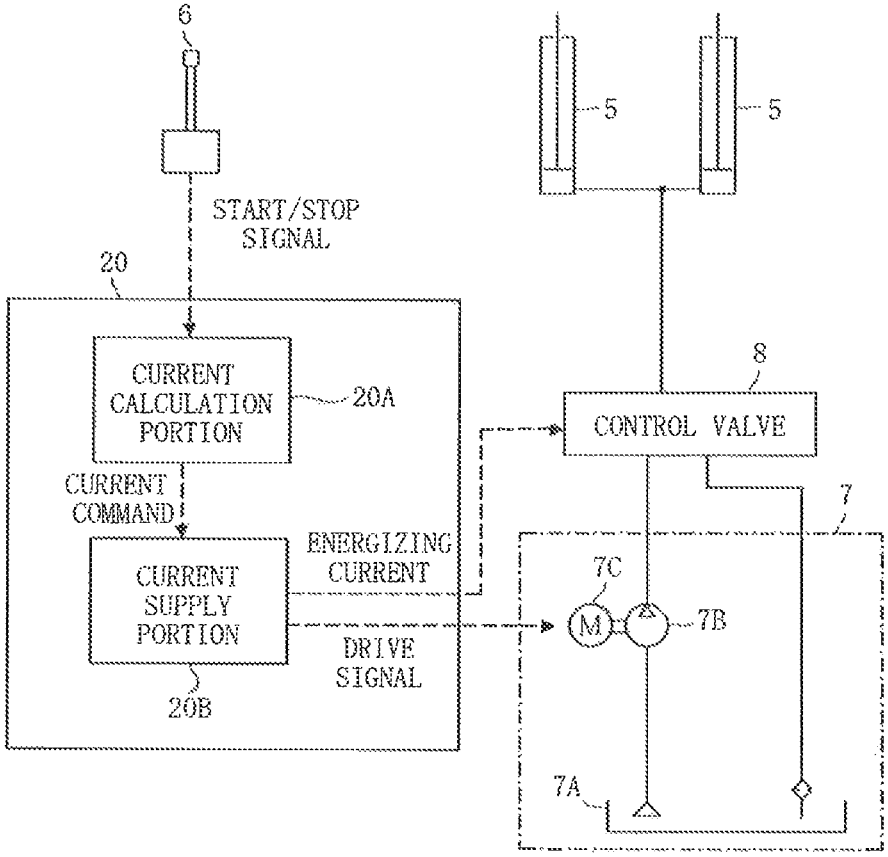
FIG. 6 Prior Art
FIG. 6 is a diagram illustrating a conventional control device and peripheral features thereof.
Figure 7A:
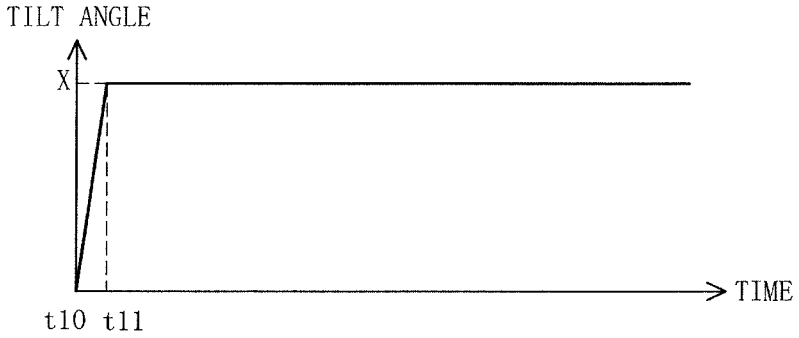
FIG. 7 provides (A) a graph showing a temporal change in tilt angle of a lift lever upon start of a lowering operation, (B) a graph showing a temporal change in displacement of first and second vibrations at the center of gravity G of a load, and (C) a graph showing a temporal change in current command value upon start of the lowering operation.
Figure 7B:
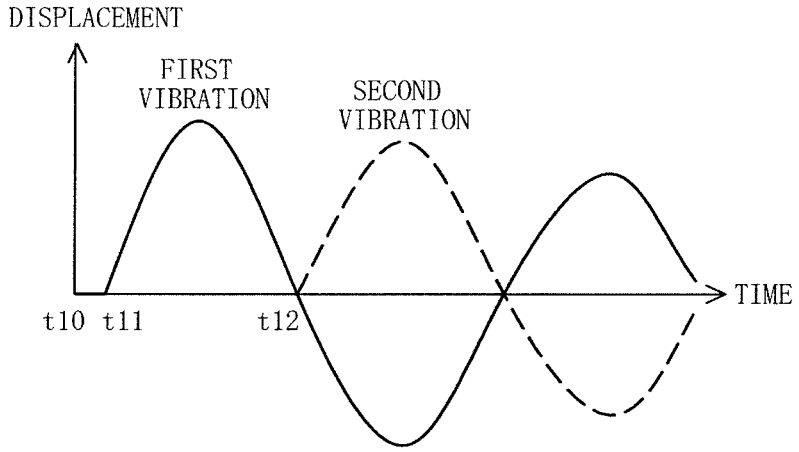
Figure 7C:
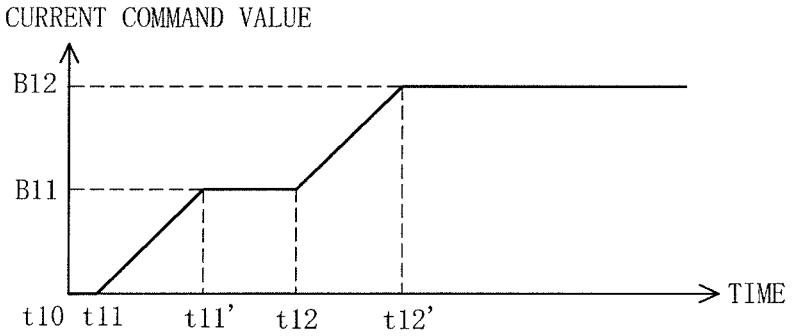

The control device 10 includes the speed calculation portion 10A for calculating a speed command value for an ascending/descending speed of the forks 3, a current calculation portion 10B for calculating a current command value for the energizing current, and a current supply portion 10C for outputting a drive signal to the motor 7C and supplying the control valve 8 with the energizing current in accordance with the current command value. In this manner, the control device 10 significantly differs from the conventional control device 20 shown in FIG. 6 in that the speed calculation portion 10A is included.

Figure 3A:
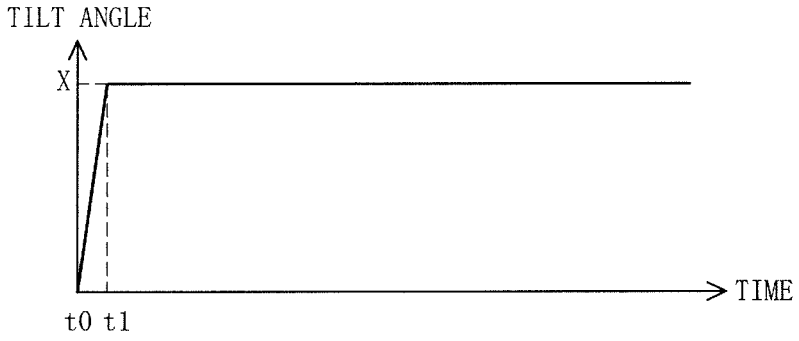
FIG. 3 provides (A) a graph showing a temporal change in tilt angle of a lift lever upon start of a lowering operation, (B) a graph showing a temporal change in speed command value upon start of the lowering operation, (C) a graph showing a temporal change in current command value upon start of the lowering operation, and (D) a graph showing a temporal change in displacement of first and second vibrations at the center of gravity G of a load.
Figure 3B:
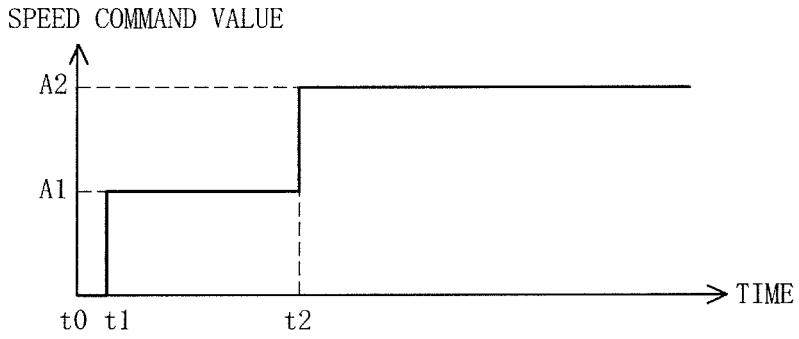
Figure 3C:
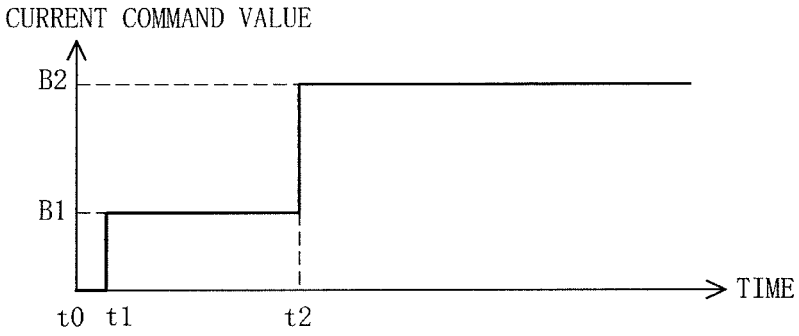
Figure 3D:
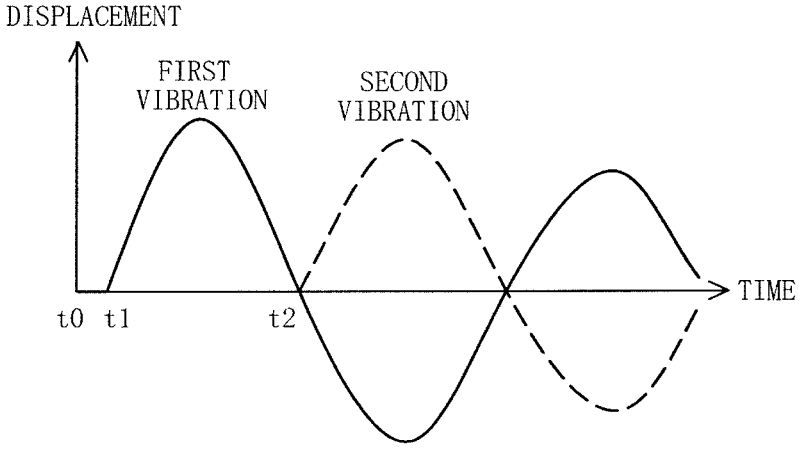

To reduce a first vibration, which is generated at the center of gravity G of the load 2 when an operation of raising/lowering the forks 3 is started, the control device 10 generates a second vibration at the center of gravity G of the load 2 when displacement of the first vibration makes a first return to zero (see, for example, FIG. 3(D)), thereby offsetting the first vibration by the second vibration. Moreover, to reduce a third vibration, which is generated at the center of gravity G of the load 2 when the operation of stopping the ascent/descent of the forks 3 is started, the control device 10 generates a fourth vibration at the center of gravity G of the load 2 when displacement of the third vibration makes a first return to zero (see, for example, FIG. 4(D)), thereby offsetting the third vibration by the fourth vibration.

To efficiently offset the first vibration by the second vibration, it is necessary to cause the first and second vibrations to be 180° out of phase with each other and also to match the first and second vibrations in terms of amplitude while considering attenuation. The conventional control device 20 has difficulty in matching the first and second vibrations in terms of amplitude, but the control device 10 according to the present embodiment renders it possible to readily match the first and second vibrations in terms of amplitude by the speed calculation portion 10A calculating the speed command value for the ascending/descending speed of the forks 3, which is linearly related to the amplitude of the vibrations.

Similarly, to efficiently offset the third vibration by the fourth vibration, it is necessary to cause the third and fourth vibrations to be 180° out of phase with each other and also to match the third and fourth vibrations in terms of amplitude while considering attenuation. In this regard, in the present invention, the speed calculation portion 10A is provided, as described above, so that the ascending/descending speed of the forks 3 can be accurately controlled and hence the third and fourth vibrations can be readily matched in terms of amplitude.

Furthermore, the conventional control device 20 causes the forks 3 to descend (or ascend) gradually in two steps, whereas the control device 10 according to the present embodiment causes the forks 3 to descend (or ascend) swiftly in two phases, as will be described below. Accordingly, the present embodiment renders it possible to reduce a delay in movement of the forks 3 when a raising/lowering operation is started.

Hereinafter, operations of the control device 10 will be described in detail with reference to FIGS. 3 and 4.

(1) Starting the Operation of Lowering the Forks 3

When the operator shifts the lift lever 6 over a period from time $t_0$ to time $t_1$ (to change the tilt angle of the lift lever 6 from zero to X), as shown in FIG. 3(A), a start signal from the lift lever 6, regarding the tilt angle of the lift lever 6, is inputted to the speed calculation portion 10A.

On the basis of the start signal, as well as a voltage signal inputted by the load detection portion 9 and vibration data stored in the memory portion 11 and regarding the first and second vibrations, the speed calculation portion 10A calculates first and second speed command values for the descending speed of the forks 3 and determines a time to switch the speed command that is to be outputted, from a speed command regarding the first speed command value to a speed command regarding the second speed command value.

Specifically, as shown in FIG. 3(B), the speed calculation portion 10A outputs the speed command regarding the first speed command value A1 over a period from time $t_1$ to time $t_2$ and outputs the speed command regarding the second speed command value A2 from time $t_2$ onward. More specifically, at time $t_2$, the speed calculation portion 10A switches the speed command value from the first speed command value A1 to the second speed command value A2 in one step, such that the second vibration is generated when the displacement of the first vibration makes a first return to zero (time $t_2$). Note that the first speed command value A1 is approximately one half of the second speed command value A2. Moreover, the second speed command value A2 increases with the tilt angle of the lift lever 6.

The vibration data for the first vibration is data regarding, for example, correlation among the phase and the amplitude of the first vibration, the weight of the load 2, and the tilt angle of the lift lever 6. Similarly, the vibration data for the second vibration is data regarding, for example, correlation among the phase and the amplitude of the second vibration, the weight of the load 2, and the tilt angle of the lift lever 6.

The current calculation portion 10B calculates first and second current command values B1 and B2 for an energizing current with reference to data (not shown) stored in the memory portion 11 and regarding correlation between speed command values and current command values. Specifically, as shown in FIG. 3(C), over a period from time $t_1$ to time $t_2$, the current calculation portion 10B calculates the first current command value B1 for the energizing current on the basis of the first speed command value A1 and outputs a current command regarding the first current command value B1. Moreover, from time $t_2$ onward, the current calculation portion 10B calculates the second current command value B2 for the energizing current on the basis of the second speed command value A2 and outputs a current command regarding the second current command value B2. Note that the energizing current and the descending speed of the forks 3 are not linearly related, and therefore, the first speed command value A1 is less than (or greater than) approximately one half of the second current command value B2.

Over a period from time $t_1$ to time $t_2$, the current supply portion 10C supplies the second electromagnetic coil of the control valve 8 with a first energizing current in accordance with the first current command value B1 and outputs a drive signal to the motor 7C. Moreover, from time $t_2$ onward, the current supply portion 10C supplies the second electromagnetic coil with a second energizing current in accordance with the second current command value B2 and outputs a drive signal to the motor 7C.

Accordingly, as shown in FIG. 3(D), the first vibration is generated at the center of gravity G of the load 2 when the operation of raising/lowering the forks 3 is started (time $t_1$), and the second vibration is generated when the displacement of the first vibration makes a first return to zero (time $t_2$). Thus, the first vibration can be reduced by offsetting with the second vibration.

(2) Starting the Operation of Raising the Forks 3

Starting the operation of raising the forks 3 has much in common with starting the operation of lowering the forks 3, except that the tilt angle has a different polarity, the speed command value has a different polarity, and the current supply portion 10C supplies the energizing current to the first electromagnetic coil of the control valve 8. Therefore, any description thereof is omitted herein.

(3) Stopping the Operation of Lowering the Forks 3

Figure 4A:
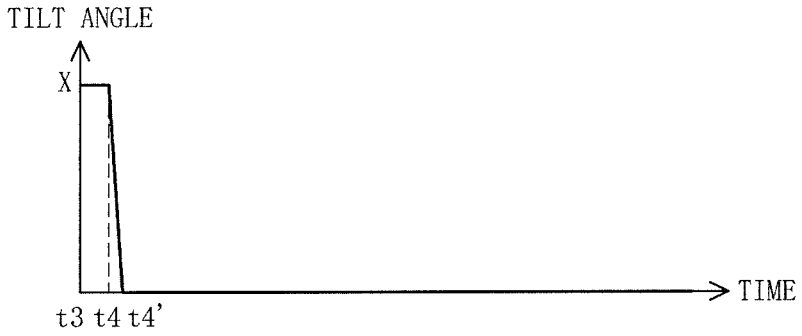
FIG. 4 provides (A) a graph showing a temporal change in tilt angle of the lift lever upon stopping of the lowering operation, (B) a graph showing a temporal change in speed command value upon stopping of the lowering operation, (C) a graph showing a temporal change in current command value upon stopping of the lowering operation, and (D) a graph showing a temporal change in displacement of third and fourth vibrations at the center of gravity G of the load.

As shown in FIG. 4(A), when the operator shifts the lift lever 6 (to change the tilt angle of the lift lever 6 from X to zero) over a period from time $t_4$ to time $t_4'$, a stop signal from the lift lever 6, regarding the tilt angle of the lift lever 6, is inputted to the speed calculation portion 10A. Note that the operation of stopping the descent starts when the tilt angle of the lift lever 6 starts to decrease from X (time $t_4$), and the operation of stopping the descent ends, i.e., the lowering operation stops, when the tilt angle of the lift lever 6 reaches zero (time $t_4'$).

On the basis of the stop signal, as well as a voltage signal inputted by the load detection portion 9 and vibration data stored in the memory portion 11 and regarding the third and fourth vibrations, the speed calculation portion 10A calculates a first intermediate speed command value, a third speed command value A3, and a second intermediate speed command value, all of which are related to the descending speed of the forks 3, and determines a time to switch between speed commands to be outputted.

Figure 4B:
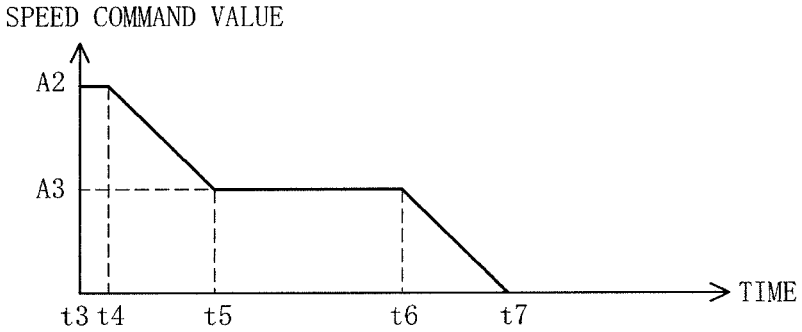

Specifically, as shown in FIG. 4(B), the speed calculation portion 10A outputs a speed command regarding the first intermediate speed command value over a period from time $t_4$ to time $t_5$, a speed command regarding the third speed command value A3 over a period from time $t_5$ to time $t_6$, and a speed command regarding the second intermediate speed command value over a period from time $t_6$ to time $t_7$. The second intermediate speed command value reaches zero at time $t_7$. More specifically, at time $t_6$, the speed calculation portion 10A switches the speed command value from the third speed command value A3 to the second intermediate speed command value, such that the fourth vibration is generated when the displacement of the third vibration makes a first return to zero (time $t_6$).

The third speed command value A3 is approximately one half of the second speed command value A2. Each of the first and second intermediate speed command values includes a plurality of speed command values whose absolute values decrease stepwise. Moreover, the first and second intermediate speed command values are approximately equal in decrease rate (strictly, the second intermediate speed command value has a lower decrease rate by an amount of attenuation).

The vibration data for the third vibration is data regarding, for example, correlation among the phase and the amplitude of the third vibration, the weight of the load 2, and the tilt angle of the lift lever 6 (i.e., the tilt angle immediately prior to starting the operation of stopping the ascent/descent). Similarly, the vibration data for the fourth vibration is data regarding, for example, correlation among the phase and the amplitude of the fourth vibration, the weight of the load 2, and the tilt angle of the lift lever 6 (i.e., the tilt angle immediately prior to starting the operation of stopping the ascent/descent).

Figure 4C:
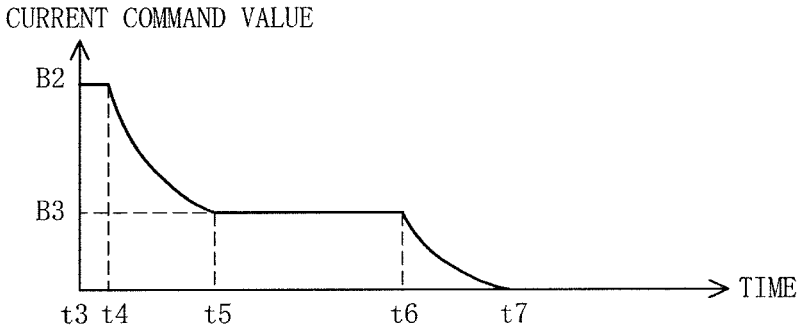

The current calculation portion 10B calculates a first intermediate current command value, a third current command value B3, and a second intermediate current command value for an energizing current with reference to data (not shown) stored in the memory portion 11 and regarding correlation between speed command values and current command values. Specifically, as shown in FIG. 4(C), over a period from time $t_4$ to time $t_5$, the current calculation portion 10B calculates the first intermediate current command value for the energizing current on the basis of the first intermediate speed command value and outputs a current command regarding the first intermediate current command value. Over a period from time $t_5$ to time $t_6$, the current calculation portion 10B calculates the third current command value B3 for the energizing current on the basis of the third speed command value A3 and outputs a current command regarding the third current command value B3. Moreover, over a period from time $t_6$ to time $t_7$, the current calculation portion 10B calculates the second intermediate current command value for the energizing current on the basis of the second intermediate speed command value and outputs a current command regarding the second intermediate current command value. The second intermediate current command value reaches zero at time $t_7$.

Over a period from time $t_4$ to time $t_5$, the current supply portion 10C supplies the second electromagnetic coil of the control valve 8 with a first intermediate energizing current in accordance with the first intermediate current command value, and outputs a drive signal to the motor 7C. Over a period from time $t_5$ to time $t_6$, the current supply portion 10C supplies the second electromagnetic coil with a third energizing current in accordance with the third current command value B3, and outputs a drive signal to the motor 7C. Moreover, over a period from time $t_6$ to time $t_7$, the current supply portion 10C supplies the second electromagnetic coil with a second intermediate energizing current in accordance with the second intermediate current command value, and outputs a drive signal to the motor 7C. The second intermediate energizing current reaches zero at time $t_7$.

Figure 4D:
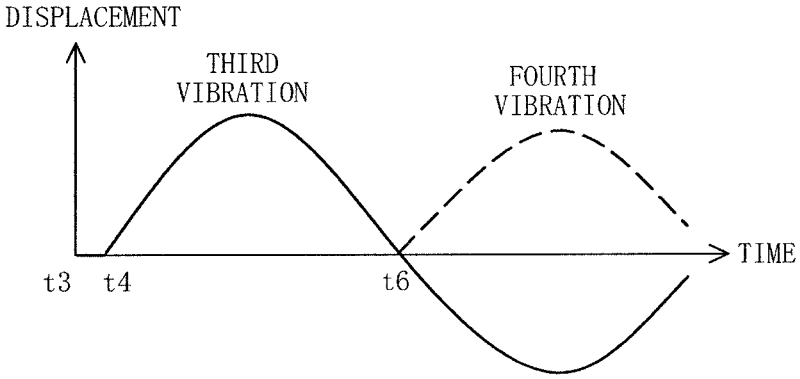
Figure 5:
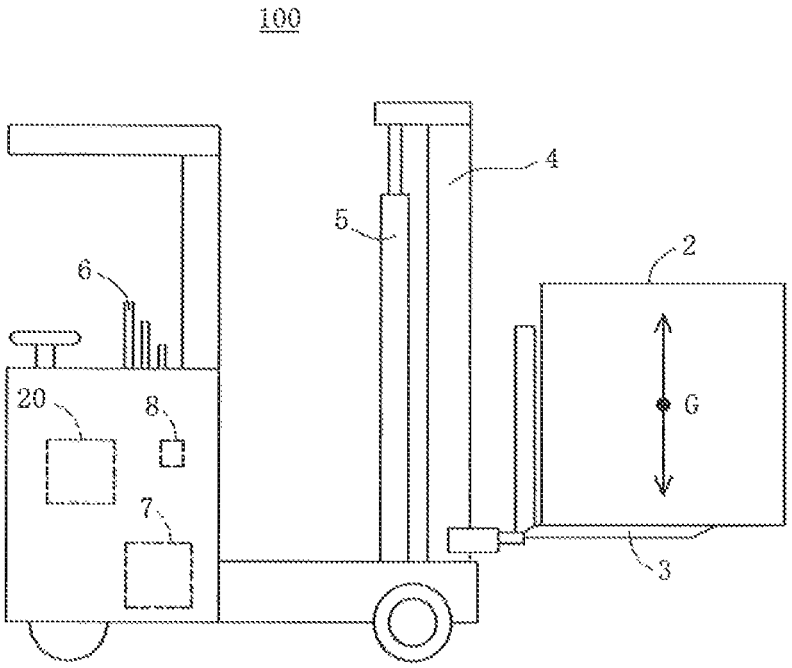
FIG. 5 Prior Art
FIG. 5 is a side view of a conventional industrial vehicle.

Accordingly, as shown in FIG. 4(D), the third vibration is generated at the center of gravity G of the load 2 when the operation of stopping the ascent/descent of the forks 3 (time $t_4$), and the fourth vibration is generated when the displacement of the third vibration makes a first return to zero (time $t_6$). Thus, the third vibration can be reduced by offsetting with the fourth vibration.

(4) Stopping the Operation of Raising the Forks 3

Stopping the operation of raising the forks 3 has much in common with stopping the operation of lowering the forks 3, except that the tilt angle has a different polarity, the speed command value has a different polarity, and the current supply portion 10C supplies the energizing current to the first electromagnetic coil of the control valve 8. Therefore, any description thereof is omitted herein.

While one embodiment of the industrial vehicle according to the present invention has been described above, the invention is not limited to the embodiment.

For example, in the embodiment, to stop the operation of raising/lowering the forks 3, the speed calculation portion 10A calculates the first intermediate speed command value, the third speed command value, and the second intermediate speed command value, but only the third speed command value may be calculated. That is, as upon the start of the operation of raising/lowering the forks 3, the speed command values may be switched in one step. Note that in such a case, the speed command value is switched from the third speed command value to zero.

The speed command value calculated by the speed calculation portion 10A may be a command value for the ascending/descending speed of the forks 3, as in the embodiment, or may be a command value for a physical amount linearly related to the ascending/descending speed of the forks 3 (e.g., the amount of hydraulic oil supplied/discharged through the control valve 8).

In the embodiment, the control device 10 and the memory portion 11 are provided as separate features, but the memory portion 11 may be included in the control device 10. For example, the speed calculation portion 10A and the current calculation portion 10B may have respective memory portions 11.

The industrial vehicle according to the present invention also encompasses forklifts other than the reach forklift or material handling vehicles other than forklifts.

DESCRIPTION OF THE REFERENCE CHARACTERS

1 forklift
2 load
3 fork
4 mast
5 hydraulic cylinder
6 lift lever
7 hydraulic device
7A tank
7B pump
7C motor
8 control valve
9 load detection portion
10 control device
10A speed calculation portion
10B current calculation portion
10C current supply portion
11 memory portion

The invention claimed is:

1. An industrial vehicle comprising:

a holding portion for holding a load;

a raising/lowering portion for performing an operation of raising/lowering the holding portion at an ascending/descending speed in accordance with an amount of hydraulic oil supplied/discharged;

an operating portion for outputting a start signal for starting the raising/lowering; operation;

a control valve for controlling the amount of hydraulic oil supplied/discharged, in accordance with an energizing current; and a control device for supplying the energizing current to the control valve, wherein, the control device includes:

a speed calculation portion for, when the start signal is inputted, calculating a first speed command value for the ascending/descending speed and a second speed command value having a higher absolute value than the first speed command value, and outputting speed commands regarding the first speed command value and the second speed command value;

a current calculation portion for calculating a first current command value for the energizing current based on the first speed command value and a second current command value for the energizing current based on the second speed command value, and outputting current commands regarding the first current command value and the second current command value; and a current supply portion for supplying the control valve with a first energizing current in accordance with the first current command value and thereafter a second energizing current in accordance with the second current command value, thereby offsetting a first vibration by a second vibration, the first vibration being generated in the load upon start of supplying the first energizing current, the second vibration being generated in the load upon start of supplying the second energizing current.

2. The industrial vehicle according to claim 1, wherein, the operating portion outputs a stop signal for stopping the raising/lowering operation, the speed calculation portion, when the stop signal is inputted, calculates a third speed command value having a lower absolute value than the second speed command value, a first intermediate speed command value between the second speed command value and the third speed command value, and a second intermediate speed command value between the third speed command value and zero, and outputting speed commands regarding the first intermediate speed command value, the third speed command value, and the second intermediate speed command value, the current calculation portion calculates a first intermediate current command value for the energizing current based on the first intermediate speed command value, a third current command value for the energizing current based on the third speed command value, and a second intermediate current command value for the energizing current based on the second intermediate speed command value, and outputs current commands regarding the first intermediate current command value, the third current command value, and the second intermediate current command value, the current supply portion supplies the control valve with a first intermediate energizing current in accordance with the first intermediate current command value, then a third energizing current in accordance with the third current command value, and then a second intermediate energizing current in accordance with the second intermediate current command value, thereby offsetting a third vibration by a fourth vibration, the third vibration being generated in the load upon switching from the second energizing current to the first intermediate energizing current, the fourth vibration being generated in the load upon switching from the third energizing current to the second intermediate energizing current.

3. The industrial vehicle according to claim 2, comprising:

a load detection portion for detecting a weight of the load; and a memory portion having stored therein first vibration data indicating a relationship between the weight and the first vibration, wherein, the speed calculation portion calculates the first speed command value and the second speed command value based on the weight and the first vibration data, and determines a time to output the speed command regarding the second speed command value.

4. The industrial vehicle according to claim 3, wherein, the memory portion has stored therein second vibration data indicating a relationship between the weight and the third vibration, and the speed calculation portion calculates the first intermediate speed command value, the third speed command value, and the second intermediate speed command value based on the second speed command value, the weight, and the second vibration data, and determines a time to output the speed command regarding the second intermediate speed command value.

5. The industrial vehicle according to claim 4, wherein the speed calculation portion outputs the speed command regarding the second speed command value such that the energizing current switches from the first energizing current to the second energizing current when displacement of the first vibration makes a first return to zero.

6. The industrial vehicle according to claim 5, wherein the speed calculation portion outputs the speed command regarding the second intermediate speed command value such that the energizing current switches from the third energizing current to the second intermediate energizing current when displacement of the third vibration makes a first return to zero.

* * * * *